US005699919A

United States Patent [19]

Pylkkanen et al.

[11] Patent Number: 5,699,919

[45] Date of Patent: Dec. 23, 1997

[54] METHOD AND APPARATUS FOR REMOVING BARK BALLS FROM A LOG FLOW

[75] Inventors: Matti Pylkkanen, Duluth; Lennart Thornquist, Doraville, both of Ga.

[73] Assignee: Andritz-Pantentverwaltungs-Gesellschaft m.b.H., Graz, Austria

[21] Appl. No.: 507,203

[22] Filed: Jul. 26, 1995

[30] Foreign Application Priority Data

Jan. 16, 1995 [FI] Finland ..... 950177

[51] Int. Cl.[6] ..... B07C 5/14

[52] U.S. Cl. ..... 209/518; 209/521; 209/630; 209/657; 209/673; 209/702

[58] Field of Search ..... 209/517, 518, 209/521, 667, 702, 705, 942, 673, 660, 657, 655, 632, 630, 627, 625

[56] References Cited

U.S. PATENT DOCUMENTS

| | | | |
|---|---|---|---|
| 1,705,569 | 3/1929 | Horstkotte | 209/705 |
| 3,522,880 | 8/1970 | Mellott et al. | 209/667 X |
| 4,199,066 | 4/1980 | Hörzer et al. | 209/626 |
| 4,836,388 | 6/1989 | Bielagus | 209/667 X |

FOREIGN PATENT DOCUMENTS

| | | |
|---|---|---|
| 430483 | 11/1983 | Sweden . |
| 548421 | 2/1977 | U.S.S.R. . |
| 1299790 | 3/1987 | U.S.S.R. . |
| 1299791 | 3/1987 | U.S.S.R. . |

*Primary Examiner*—David H. Bollinger

*Attorney, Agent, or Firm*—Birch, Stewart, Kolasch & Birch, LLP

[57] ABSTRACT

The invention relates to a method and apparatus for removing bark balls from a log flow traveling on a conveyor (3) which extends from a debarking drum (1) to a chipper (2), said conveyor (3) including a roller assembly (4) provided with an opening (5) for dumping from the conveyor (3) a sub-flow consisting of wood pieces and bark balls. The apparatus comprises an adjustable dispenser device (6) for further dividing the sub-flow falling from the conveyor (3) into a portion including mainly wood pieces and a portion including mainly bark balls.

20 Claims, 2 Drawing Sheets

METHOD AND APPARATUS FOR REMOVING BARK BALLS FROM A LOG FLOW

BACKGROUND OF THE INVENTION

The present invention relates to a method and apparatus for removing bark balls from a log flow traveling on a conveyor which extends from a barking drum to a chipper, the conveyor including a roller assembly provided with an opening for dumping from the conveyor a sub-flow consisting of short wood and bark balls.

The logs are delivered into a barking drum as large individuals or as bundles including several logs. Nowadays, it has become more and more popular to deliver the logs into a debarking as large bundles e.g. by means of a PowerFeed-conveyor (trademark).

The relative movement and friction of logs against each other inside a debarking drum effectively result in the bark being stripped off the wood surface. Loose finely crushed bark mostly falls through bark slots included in the drum onto a bark conveyor located below the drum. Any bark removed as long strips or large sheets strives to join the logs out of the discharge end of a debarking drum.

In practice, the most common types of softwood can be readily debarked in a debarking drum; their bark pulverizes and falls out through the bark opening of a drum, one of the few exceptions being spruce. Several types of hardwood, such as eucalyptus, acacia, hickory and birch among others are difficult to debark, as their bark comes off the wood surface either as sheets or long strips. In addition, the bark is very tough in terms of its mechanical properties. For the above reasons, nearly all debarking plants, designed especially for peeling or debarking such difficult hardwood, experience some level of practical problems in the separation of loose, carry over bark. When the bark is entangled with logs and comes out of the discharge end of a debarking drum as individual strips or bark balls (in this context, the term bark balls refers to a heap formed by bark strips more or less entangled together and possibly including also pieces of wood, splinters etc.), an effort is made for removing most of such bark prior to chipping or a like process. Partial separation of the bark can be achieved by means of a roller assembly designed especially for the purpose. However, the bark balls and some of the long bark strips are difficult to remove by means of a roller assembly; a rather dense, wood-saving (pieces of wood) roller assembly tends to leave nearly the entire bark ball and some of the loose bark pieces in the log flow, a sparse roller assembly, on the other hand, removes most of the loose bark pieces and even some of the bark balls but, at the same time, causes major losses of wood.

Earlier efforts have been made for preventing the passage of bark balls into a chipper by stopping the line between a debarking drum and a chipper and by removing the bark pieces manually or by means of a hydraulic grabble. Such a procedure disturbs the process and requires manpower. On the other hand, if the bark is carried into the chipper along with a log flow, the amount of bark increases amongst the wood chips and this can cause serious problems in the following processes.

One prior known solution involves the separation of bark by means of openings included in a roller assembly or by means of roller assemblies designed with a sparse spacing. A problem with these solutions is that the short wood always ends up on a bark line, which causes further losses of wood.

SUMMARY OF THE INVENTION

In view of eliminating these drawbacks, an objective of the invention is to provide a method and apparatus for removing bark balls from a log flow and from a barking drum—chipper line without stopping the line and, thus, the avoiding losses of wood.

According to the invention, the objective is met in such a manner and a method of the invention is characterized in that a sub-flow falling down from a conveyor is further divided into a portion including mainly stumps and a portion including mainly bark balls.

An apparatus of the invention is characterized in that an adjustable dispenser device is provided for further dividing a sub-flow falling down from a conveyor into a portion including mainly short wood/wood pieces and a portion including mainly bark balls.

Thus, it is possible to carry the bark balls onto a bark conveyor, whereby the amount of bark amongst the wood chips is substantially reduced and yet the loss of wood remains reasonable. Thus, the losses of wood are principally only caused by wood pieces entangled with the bark balls. The removal of individual bark pieces must be attempted by means of a roller assembly. The use of an opening or a so-called breakage trap included in the roller assembly is not sensible/possible for this particular purpose.

BRIEF DESCRIPTION OF THE INVENTION

The invention will now be described in more detail by way of an example with reference made to the accompanying drawings, in which.

DETAILED DESCRIPTION OF THE INVENTION

Figure 1:
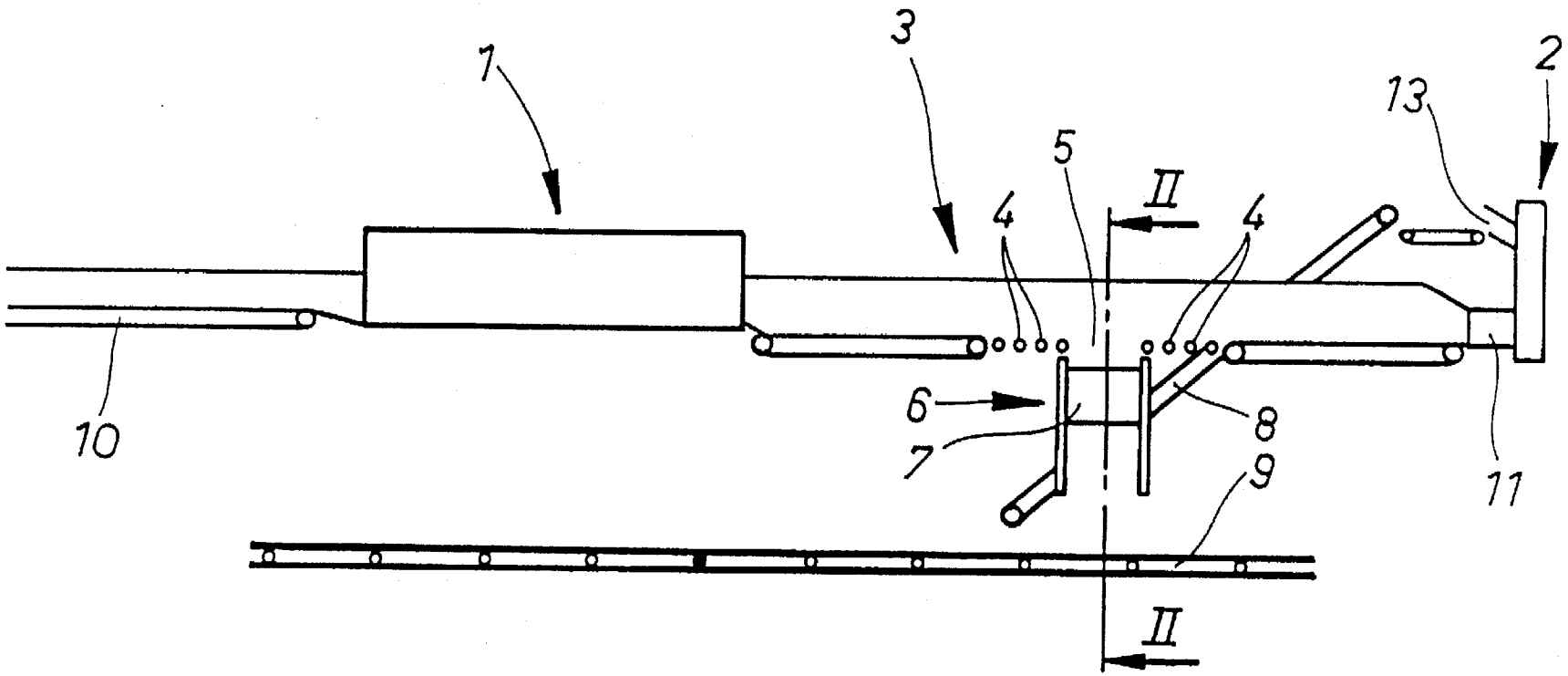
FIG. 1 shows schematically a debarking drum—chipper line, which is provided with an apparatus of the invention.

FIG. 1 illustrates schematically a wood processing line, including a debarking drum which is generally designated by reference numeral 1, a chipper by reference numeral 2, and a conveyor therebetween by reference numeral 3.

A log flow travels from left to right in FIG. 1. The logs to be processed are lifted onto a feed conveyor 10 serving the debarking drum 1 and delivering such logs into the debarking drum 1. The debarking drum 1 effects the removal of bark slots from the log surfaces and most of the bark falls through bark slots (not shown) included in the drum 1 down onto a bark conveyor 9 below. However, some of the bark avoids the fall and are carried along with the debarked logs, a few of those possibly being broken into short pieces, out of the discharge end of said drum 1 onto the conveyor 3. In the case of certain types of hardwood, such as hickory, eucalyptus and acacia, as well as spruce from softwood trees, the bark pieces are at this point usually in the form of entangled heaps which are called bark balls.

The conveyor 3 includes a roller assembly 4, which is provided with an opening 5, a so-called breakage trap, for dumping from the conveyor 3 a sub-flow consisting of wood pieces and bark balls. The opening 5 is simply designed in such a manner that some of the rollers included in the roller assembly 4 are omitted. The opening 5 has no effect on long logs, which advance directly into an inlet opening 11 included in the chipper 2.

Figure 2:
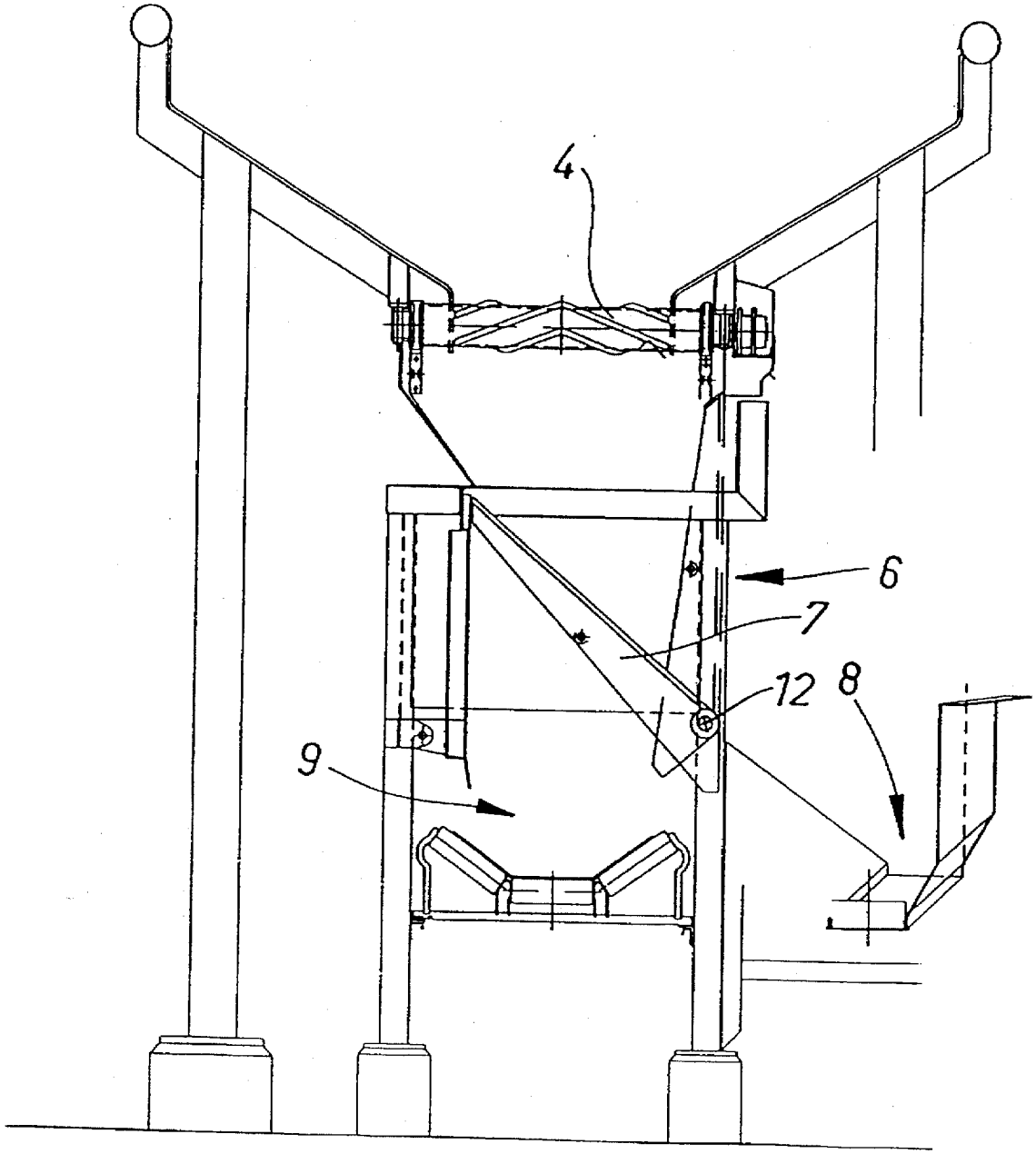
FIG. 2 shows a section along a line II—II in FIG. 1.

The sub-flow falling from the conveyor 3 through the opening 5 is further divided into a portion including mainly wood pieces and a portion including mainly bark balls. In practice, this is effected by means of a dispenser device 6 included in a funnel set below the opening 5. The dispenser device 6 comprises preferably a gate 7, which in the example of FIG. 2 is hinged at its bottom end in such a manner that the gate 7 is pivotable by means of a suitable actuator, e.g. a hydraulic cylinder (not shown), around a pivot axis 12 to an upright position shown by dash lines in FIG. 2 or descendable to a lowered position shown by solid lines.

In the lowered position, the gate 7 deflects the pieces (wood pieces) falling thereupon aside onto a breakage conveyor 8, from which they are guided, in the example shown in FIG. 1, into a separate inlet spout 13 included in the chipper 2 or alternatively into a separate small chipper (not shown). In the upright position, the gate 7 allows the pieces (bark balls) to fall or be deflected onto the bark conveyor 9.

The dispenser device 6 can be controlled manually or it can be adapted for automatic control, whereby the control can be effected for example by means of a detector device (not shown) scanning the log flow advancing on the conveyor 3.

In practice, the dispenser device 6 can be controlled e.g. in such a manner that, as a bark ball is detected on the conveyor 3, the gate is turned to the upright position just before the fall of the bark ball through the opening 5, whereby the bark ball falls onto the bark conveyor 9. Thereafter, the gate may return automatically to the lowered position, whereby all pieces, mainly wood pieces, falling through the opening 5 are deflected onto the breakage conveyor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for removing bark balls from a log flow traveling on a conveyor comprising the steps of:

conveying the log flow from a debarking drum to a chipper on a conveyor, said conveyor including a roller assembly disposed at a pre-determined distance upstream from said chipper and having an opening for dumping from said conveyor a sub-flow consisting of wood pieces and bark balls, and dividing the sub-flow dumped from said conveyor by a dividing means into a first portion including mainly wood pieces and a second portion including mainly bark balls.

2. The method as set forth in claim 1, wherein the dividing means is a controllable dispenser device (6).

3. The method as set forth in claim 2, further comprising the step of scanning the log flow with detection means to detect the presence of bark balls therein.

4. The method as set forth in claim 3, further comprising the step of controlling said dispenser device on the basis of the detection by said detecting means.

5. An assembly for removing bark balls from a log flow comprising a debarking drum, a chipper, a conveyor extending between said drum and said chipper, said conveyor including a roller assembly provided at a pre-determined distance upstream from said chipper with an opening for dumping therefrom a sub-flow containing wood pieces and bark balls, and a controllable dispenser device for dividing the sub-flow falling from said conveyor into a first portion including mainly wood pieces and a second portion including mainly bark balls.

6. The assembly as set forth in claim 5, wherein the dispenser device includes a pivotable gate.

7. The assembly as set forth in claim 6, wherein the dispenser device is provided with two positions.

8. The assembly as set forth in claim 6, wherein the dispenser device is adapted to be manually controlled.

9. The assembly as set forth in claim 6, further comprising a detection element for scanning the log flow, wherein the dispenser device is adapted to be controllable by the detector element.

10. The assembly as set forth in claim 6, further comprising a breakage conveyor and a bark conveyor, wherein the dispenser device is adapted to deflect the wood pieces onto said breakage conveyor and the bark balls onto said bark conveyor.

11. The assembly as set forth in claim 5, wherein the dispenser device is provided with two positions.

12. The assembly as set forth in claim 11, wherein the dispenser device is adapted to be manually controlled.

13. The assembly as set forth in claim 11, further comprising a detection element for scanning the log flow, wherein the dispenser device is adapted to be controllable by the detector element.

14. The assembly as set forth in claim 11, further comprising a breakage conveyor and a bark conveyor, wherein the dispenser device is adapted to deflect the wood pieces onto said breakage conveyor and the bark balls onto said bark conveyor.

15. The assembly as set forth in claim 5, wherein the dispenser device is adapted to be manually controlled.

16. The assembly as set forth in claim 15, further comprising a detection element for scanning the log flow, wherein the dispenser device is adapted to be controllable by the detector element.

17. The assembly as set forth in claim 15, further comprising a breakage conveyor and a bark conveyor, wherein the dispenser device is adapted to deflect the wood pieces onto said breakage conveyor and the bark balls onto said bark conveyor.

18. The assembly as set forth in claim 5, further comprising a detection element for scanning the log flow, wherein the dispenser device is adapted to be controllable by the detector element.

19. The assembly as set forth in claim 18, further comprising a breakage conveyor and a bark conveyor, wherein the dispenser device is adapted to deflect the wood pieces onto said breakage conveyor and the bark balls onto said bark conveyor.

20. The assembly as set forth in claim 5, further comprising a breakage conveyor and a bark conveyor, wherein the dispenser device is adapted to deflect the wood pieces onto said breakage conveyor and the bark balls onto said bark conveyor.

* * * * *